US005189974A

United States Patent [19]

Masters

[11] Patent Number: 5,189,974

[45] Date of Patent: Mar. 2, 1993

[54] KAYAK CATAMARAN

[76] Inventor: William E. Masters, 100 Bentcreek Ct., Easley, S.C. 29642

[21] Appl. No.: 724,741

[22] Filed: Jul. 2, 1991

[51] Int. Cl.[5] ..... B63B 1/14

[52] U.S. Cl. ..... 114/61; 114/347

[58] Field of Search ..... 114/283, 61, 347, 123; 441/73, 72

[56] References Cited

U.S. PATENT DOCUMENTS

| | | | |
|---|---|---|---|
| 2,119,775 | 6/1938 | Chase | 114/61 |
| 3,119,131 | 1/1964 | Yoder | 441/72 |
| 3,950,807 | 4/1976 | Sharpe | 441/68 |
| 4,503,799 | 3/1985 | Masters | 114/347 X |
| 4,621,587 | 11/1986 | Pool | 114/347 X |
| 4,890,570 | 1/1990 | Hofmeister | 114/123 X |

FOREIGN PATENT DOCUMENTS

| | | | |
|---|---|---|---|
| 109766 | 4/1990 | Japan | 114/283 |
| 8600537 | 10/1987 | Netherlands | 114/347 |

*Primary Examiner*—Sherman Basinger
*Attorney, Agent, or Firm*—Cort Flint

[57] ABSTRACT

A catamaran kayak is disclosed which comprises a plurality of hulls (10, 12) which are joined together and laterally spaced by elongated connectors (B). Flexible couplings (C) are formed on the hulls which receive the ends of elongated connectors (B) and provide for flexibility between the hulls and the elongated connectors in three degrees of freedom. The flexible couplings include flexible bosses (30) which are formed on the kayak hulls and which receive the ends of the elongated connectors. Journals (36) are carried in the flexible bosses and flexible bushings (38) may be carried between the elongated connectors and the journal to control the amount of flexibility provided. This enables flexibility of each flexible coupling (C) to be controlled, if desired, in accordance with the style, weight, and other characteristics of the individual boaters, as well as tailoring the catamaran kayak for the type of water conditions in which it is used. In addition, the flex characteristics of the coupling between the kayaks, and hence the performance of the kayak, may be controlled by the thickness of the hull and the geometry of the hull in the area which the flexible bosses (30) are formed. Preferably, the hulls are molded from a flexible polymeric material and flexible bosses (30) are formed as one piece with the hull.

31 Claims, 5 Drawing Sheets

Fig. 8.
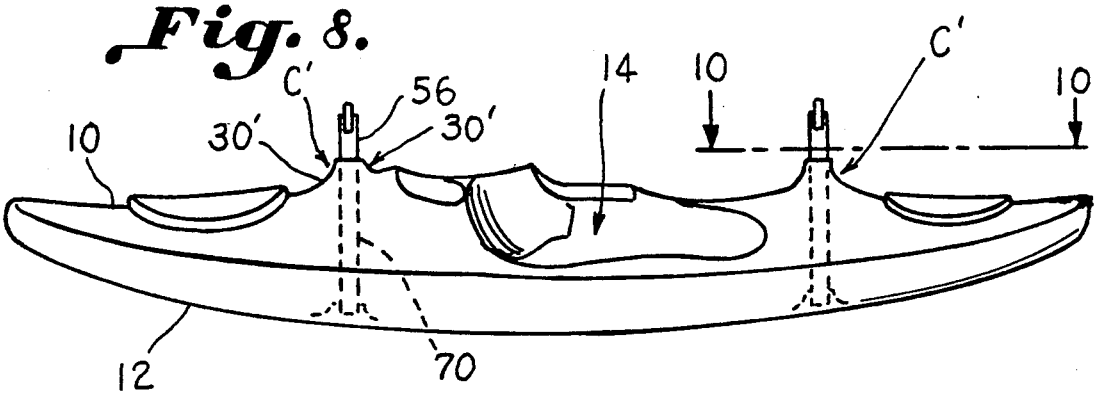
Fig. 9.
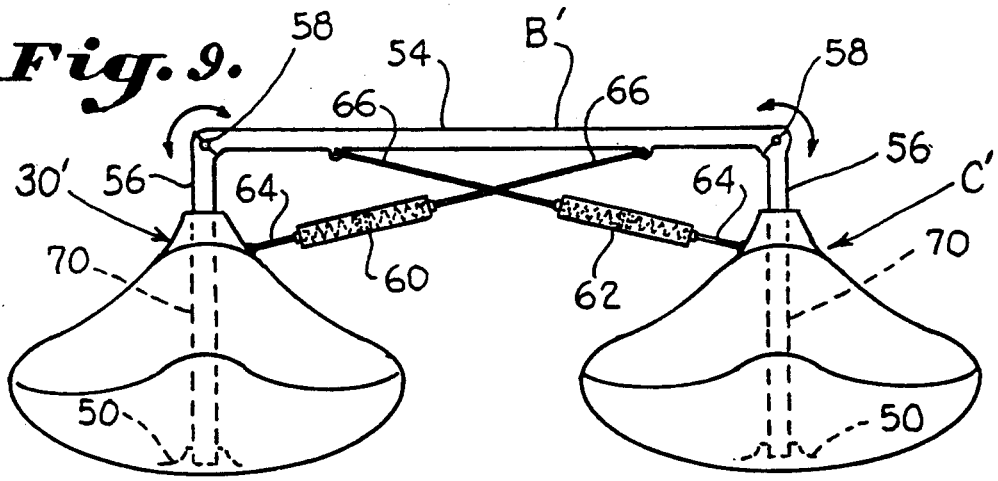
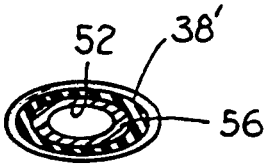
Fig. 10-A.
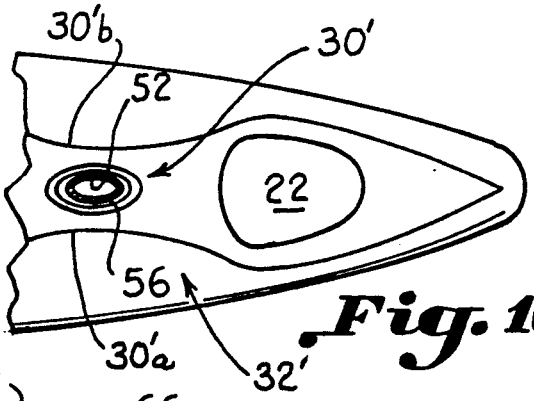
Fig. 10.
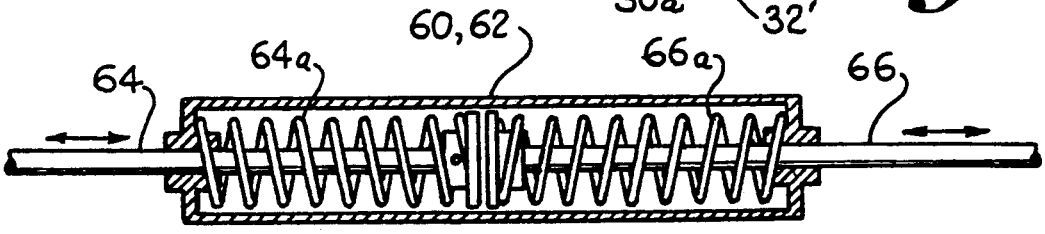
Fig. 11.

KAYAK CATAMARAN

BACKGROUND OF THE INVENTION

Kayaks have become increasingly popular due to the sport of white water boating and the affordability of kayaks. The typical kayak includes a cockpit seat for one boater because of the agility required to handle the kayak. With the increase in popularity of kayaking and white water boating, the need has arisen for a kayak which will accommodate a plurality of boaters. In particular, the provision of a kayak which accommodates plural boaters and which can be handled in a safe and effective manner, particularly in white water conditions, is a considerable problem to which considerable attention need be given.

Previously, kayaks and canoes have been provided which are constructed from a flexible plastic skin which yields upon impact with the water and various obstacles encountered in white water conditions. The skin of the hull is very flexible and typically includes frame elements within the hull for supporting the hull, such as disclosed in U.S. Pat. Nos. 4,227,272 and 4,407,216. U.S. Pat. No. 4,589,365 discloses an open cockpit kayak in which the boater sits in an open deck formed in the upper hull of the kayak, rather than within the kayak hull as in the later two patents. Other kayaks have been provided similar to the kayaks disclosed in the later two patents which include two cockpit seats. For example, sea-going kayaks have been provided which are considerably longer than the typical white water kayaks and include two cockpits spaced longitudinally along the length of the kayak.

Catamaran-type boats are known which use plural hulls. U.S. Pat. No. 4,621,587 discloses a catamaran assembly which includes a pair of canoe hulls laterally joined and spaced apart by a trampoline frame. However, the hulls are rigid fiberglass and the frame is rigidly attached to the hulls. U.S. Pat. No. 4,406,239 discloses a catamaran sailboat having a pair of hulls joined together by wedge-shaped cross beams oriented to provide balanced distribution of loading on the hulls and cross beams. U.S. Pat. No. 3,763,813 discloses an inflatable canoe and outrigger joined together by a rigid frame. U.S. Pat. No. 4,102,287 discloses a catamaran sailboat wherein the hulls may pivot 180 degrees apart and be locked in either position to facilitate sailing of the boat after it has capsized. U.S. Pat. No. 4,890,570 discloses a catamaran sailboat having hulls joined together by a trampoline frame which permits some relative movement between the hulls. The above catamaran constructions are for use on relatively calm bodies of water and would not be suitable for white water conditions where considerable flexing and movement of the hulls relative to one another would be encountered.

Accordingly, an object of the invention is to provide a catamaran kayak having plural hulls rigidly connected with flexible couplings which allow the hulls to flex independently so that the catamaran may be handled effectively and safely in white water conditions.

Another object of the present invention is to provide a catamaran kayak having plural hulls with semi-independent flexing of the hulls so that boaters positioned on the hulls have freedom of movement in which to stroke and/or counterbalance the other paddler to keep the catamaran upright.

Another object of the invention is to provide a catamaran kayak having plural flexible hulls which are molded as one piece with flexible bosses which accommodate connection to rigid frame members so that the kayak hulls flex independently in three degrees of freedom.

Still another object of the invention is to provide a catamaran kayak having plural hulls with cockpits wherein rigid connectors space the hulls and are connected to the hulls by flexible couplings whose flexibility may be independently adjusted so that the performance of the hulls is tailored for the water conditions, and the weights and styles of the boaters.

SUMMARY OF THE INVENTION

The above objections are accomplished according to the present invention by providing a catamaran kayak having a plurality of laterally spaced longitudinally extending hulls. In a preferred embodiment, the hulls are constructed from a flexible polymeric material. A plurality of cockpits are carried by the hulls for accommodating a boater in a paddling position. A plurality of rigid elongated connectors are spaced from one another along the length of the hulls which extend laterally between the hulls. The elongated connectors have opposing free ends which are connected to the hulls. A flexible coupling is provided for coupling the ends of the elongated connectors to the hulls so that the hulls and elongated connectors move relative to each other in three-degrees of freedom. The flexible couplings include flexible bosses formed as one-piece with the flexible hulls for receiving opposing ends of the elongated connectors. A journal is carried by the flexible bosses which receives opposing ends of the elongated connectors. The journal includes hollow coupling sleeves fitted within the flexible bosses which receive the ends of the elongated connectors. The journal includes a flexible bushing which is disposed inside the bosses which receive the ends of the elongated connectors. The couplings include adjustment mean for adjusting the lateral distance between the hulls to accommodate different water conditions. The flexible coupling includes a flex control for controlling the flexibility of the flexible coupling s that each coupling may be provided with a desired flex characteristic. The flex control includes an adjustable durometer bushing disposed between the elongated connector and the journal. The bushing comprises a plurality of bushings having a different resiliency to provide the coupling with a desired flex characteristic. The thickness and geometry of the flexible bosses molded as one piece with the hull may also be varied during construction to provide desired flex characteristics.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein:

FIG. 3 is a sectional view taken along line 3—3 of FIG. 2;

FIG. 8 is an elevation of an alternate embodiment of a catamaran kayak according to the invention;

FIG. 9 is a front view of an alternate embodiment of the invention;

FIG. 10 is a partial top plan view of an alternate embodiment of the invention; and FIG. 10*a* is top plan view of a flexible boss incorporating a resilient bushing according to the embodiment of FIG. 10.

FIG. 11 is a cross-sectional view of a dampening mechanism for controlling the pivotal movement of tubular connectors in the alternate embodiment of the invention.

DESCRIPTION OF A PREFERRED EMBODIMENT

Referring now in more detail to the drawings, a catamaran kayak-type boat is illustrated, generally at A, which includes a pair of hulls 10 formed as flexible skin enclosures from a suitable polymeric material such as a polyethylene material. A suitable polyethylene material is "Marlex" brand polyethylene manufactured by Phillips Chemical Company. The hull is typically made by utilizing conventional rotational molding machinery or may be made by vacuum molding or blow molding to provide a continuously enclosed hull having the shape illustrated. Each hull includes an upper hull 12 which is molded to have a preferred construction as illustrated for the purposes of connecting the hulls together.

Figure 1:
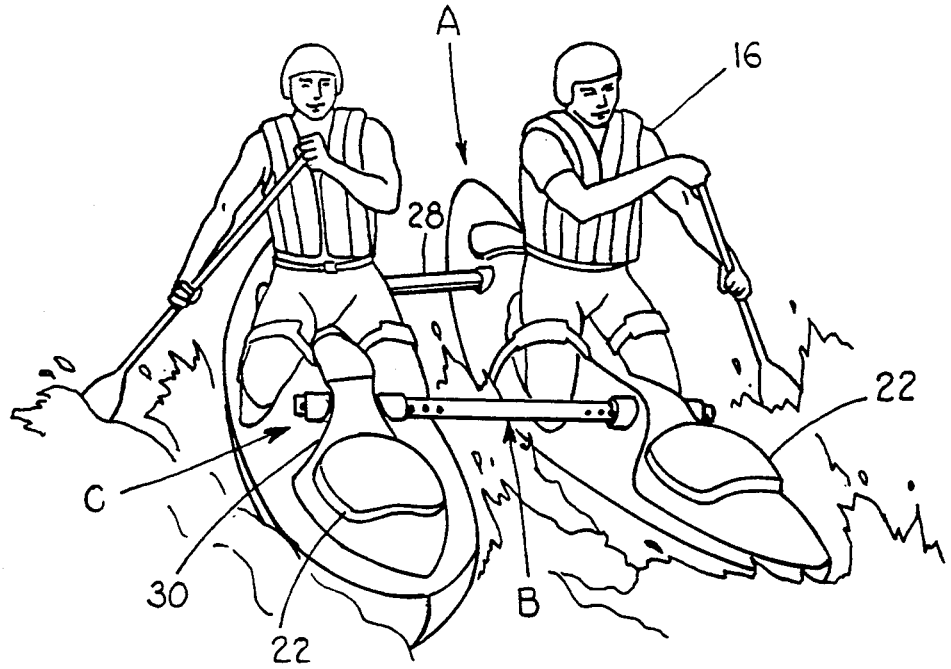
FIG. 1 is a perspective view illustrating a catamaran kayak with boaters seated in a paddling position.
Figure 2:
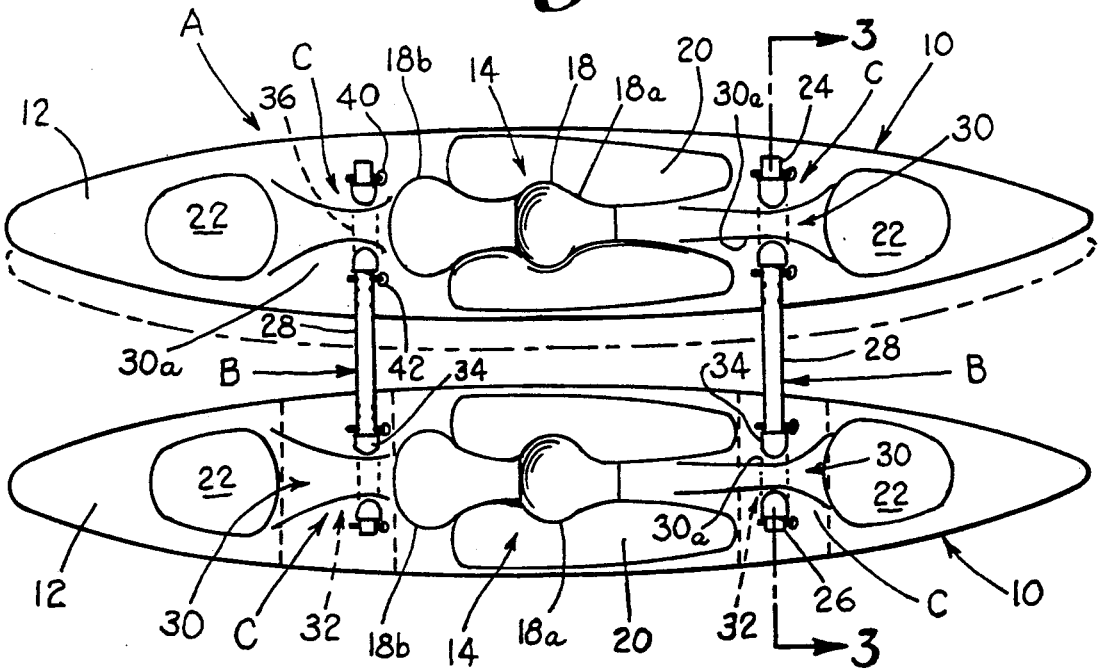
FIG. 2 is a top plan view of a catamaran kayak in accordance with the invention.

As can best be seen in FIGS. 1 and 2, the upper hull 12 of the kayak is molded to include a cockpit means, designated generally as 14, in a boater 16 is accommodated in a paddling position, preferably on his knees. The cockpit means includes an integrally molded saddle seat 18 that allows the boater to kneel for more leverage and lower the center of gravity, or sit atop the kayak for visibility and comfort. For this purpose, a forward seat 18*a* allows the boater to be seated in a first kneeling position and a second seat 18*b* allows the boater to sit atop the kayak in a second conventional seated position. In the kneeling position, the knees rest on a cockpit floor 20. In the seated position, the boater's feet may rest on the cockpit floor. A pair of forward and aft storage hatches 22 are provided for access to within the hull for storage. In the preferred embodiment, the hulls are identical. Any number of saddle seats may be utilized as the hull permits.

Figure 5:
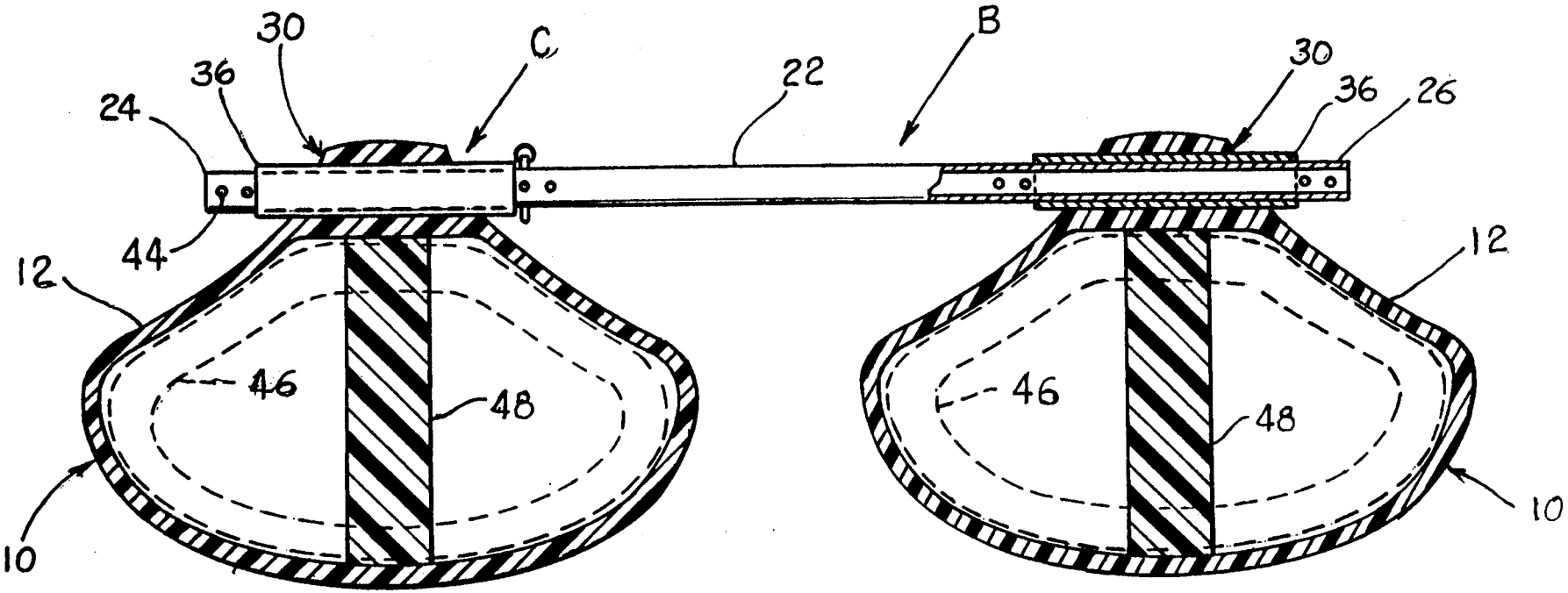
FIG. 5 is a sectional view taken along line 5—5 of FIG. 4.
Figure 4:
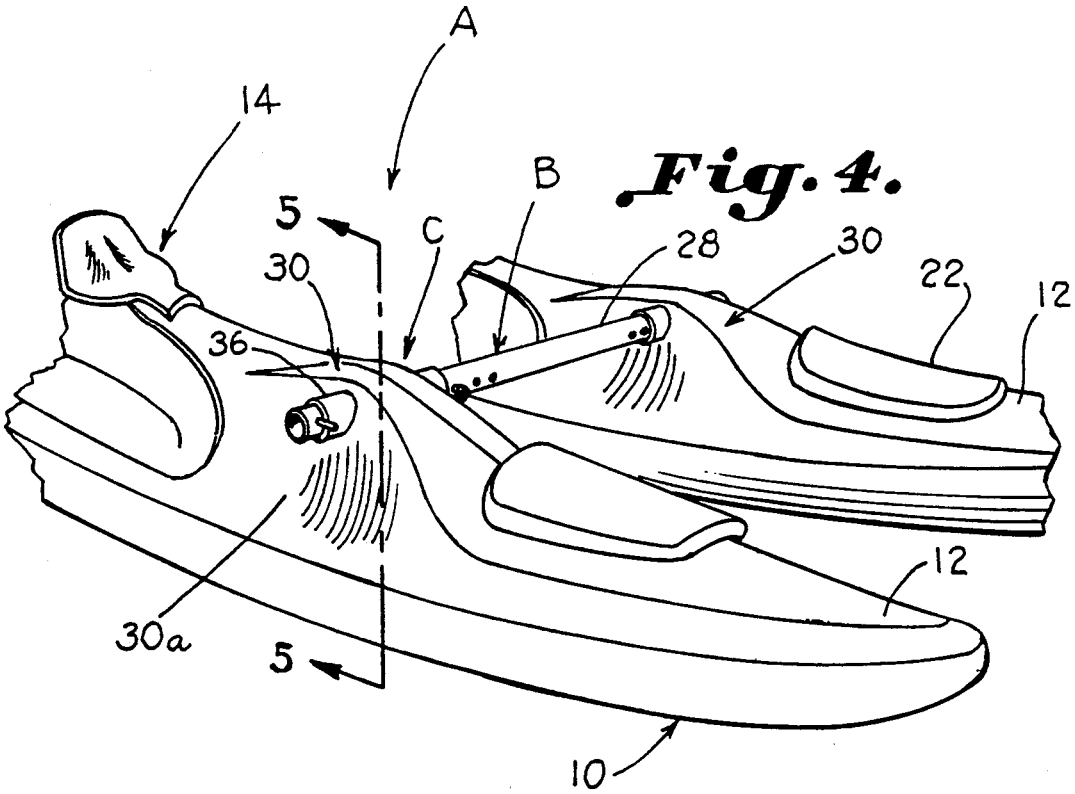
FIG. 4 is a partial perspective view of a catamaran kayak according to the invention.
Figure 5:
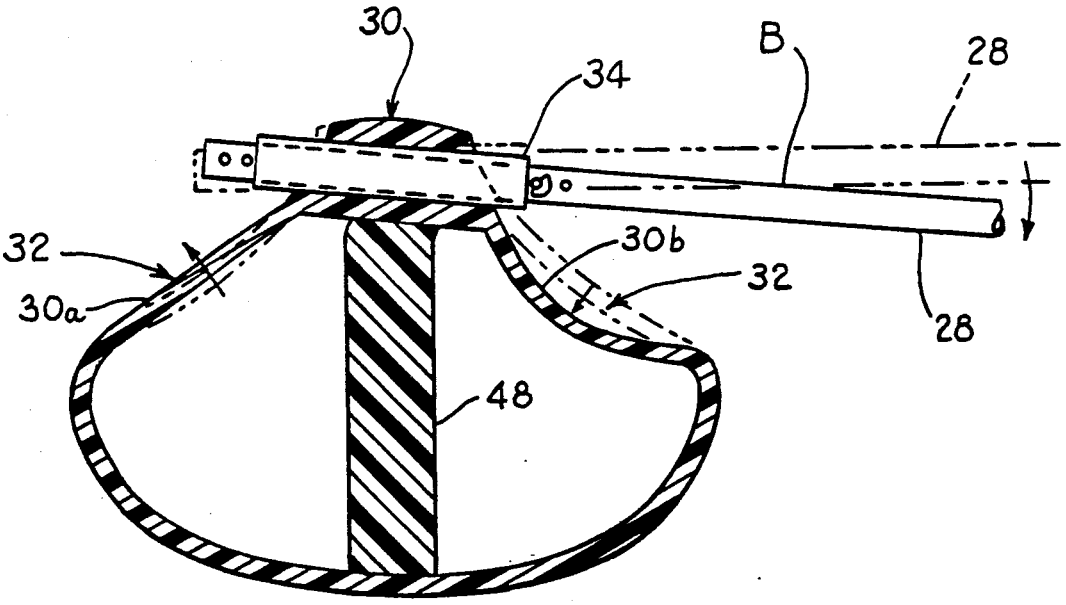

Hulls 10 are spaced apart by a frame means which includes a plurality of rigid elongated connector means, designated generally as B, having opposing free ends 24 and 26 connected to the hulls. Preferably, the elongated connector means include cylindrical tubes 28. Flexible coupling means, designated generally as C, is provided for coupling elongated connector means B to hulls 10 so that the hulls and the elongated connector means move relative to each other in three degrees of freedom. In the preferred embodiment, coupling means C include flexible bosses, designated generally as 30, which are molded as one piece with the hulls. Tubes 28 are rigid and, hence, are able to only twist inside the boss 30. Flexible bosses 30 are formed by a raised portion defined by webs 30*a*, 30*b* molded and blended into upper hull 12, as can best be seen in FIGS. 3–5. As can best be seen in FIG. 5, webs 30*a*, 30*b* are concave. Webs 30*b* deflect inward to flex with relative downward movement of tubes 28, and webs 30*a* deflect inward with relative upward movement of the tubes, as shown in dotted lines (FIG. 5). Flexible bosses 30 flex independently, and with the flexible hull skin in a coupling area, designated generally as 32. Flexible bosses 30 can flex because the polyethylene plastic material has a certain degree of flexibility. Means for controlling the flexibility of bosses 30, and hence the flexibility of the coupling, can be provided by controlling the thickness of the plastic material in this area, as well as the geometry of the bosses in the coupling area.

Figure 6:
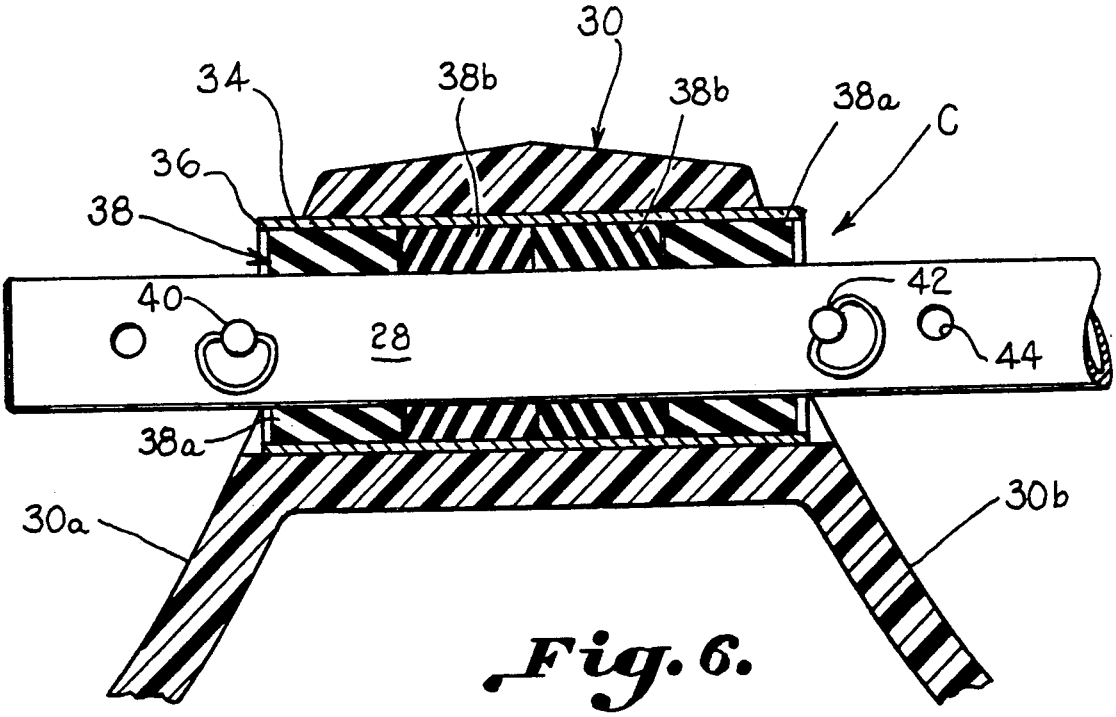
FIG. 6 is an enlarged sectional view illustrating a flexible coupling whose flex characteristics may be adjusted in accordance with the present invention.

Journal means 34 are carried by flexible bosses 30 for receiving opposing ends 24, 26 of the elongated connector tubes so that the hulls rotate in a pitch motion relative to the elongated connector tubes. Preferably, the journal means 34 are provided by hollow coupling sleeves 36 fitted within the bosses which receive ends 24, 26 of tubes 28. Means for controlling the flexibility of coupling means C may also include at least one resilient bushing, designated generally as 38, interposed between hollow sleeves 36 and tubes 28, as can best be seen in FIGS. 6 and 7. Bushing 38 may be a single bushing or may include a plurality of individual bushings, e.g. shaped like O-rings, stacked side by side on tubes 28, as can best be seen in FIG. 6. In either case, the bushings may be made out of any suitable resilient or elastic material such as urethane or rubber. Bushings having different durometers can be used to change the flex characteristics of coupling means C. If a single bushing is utilized, a bushing with a desired flex characteristic can be utilized to provide different flex characteristics at each of the four coupling means C, in the case where two hulls are utilized. It is also anticipated that more than a pair of hulls may be utilized in accordance with the invention, while in the preferred embodiment, only a pair of hulls is illustrated. The purpose of providing different flex characteristics in the different couplings of the hulls is to compensate for different types of water conditions in which the hulls may be used, and for different boater characteristics. For example, if a heavy boater is on the right hull, and a lighter boater is on the left hull, it may be desirable to make the coupling in the hull of the heavier boater more flexible than the couplings in the hull of the lighter boater. This compensates for the weight difference and forces imparted by the heavier paddler. In this manner, a more equal distribution of paddling forces and control of the combination of hulls is provided. Further, each flex coupling may be customized by using flexible bushings within each coupling of different durometers. For example, as can best be seen in FIG. 6, outer bushings 38*a* may be utilized which are harder than interior bushings 38*b*. If it is desired to make coupling means less flexible, then the softer bushings 38 would be placed in the middle, and the harder bushings would be placed on the outside, as is illustrated in FIG. 6. However, if it is desired to make coupling means C more flexible, then harder bushings 38*a* may be placed in the middle and the softer bushings 38*b* may be placed on the outside. In this manner, the flexibility of the coupling may be adjusted on the river. The means of controlling the flexibility of coupling C may include adjusting the durometer of the bushings used in the flexible coupling in the field as well as predetermining the geometry and thickness of molded bosses 30. Of course, the control of the flexibility provided by the geometry and thickness of boss 30 in the coupling area 32 must be done during manufacture while the advantage of the flexibility provided by bushings is that they may be adjusted in use. In either case, the performance of the catamaran may be customized for water conditions, as well as the weight of the boaters, as well as the experience and styles of the boaters.

Sleeves 36 also provide for adjusting the length of the elongated connector tubes so that the lateral separation between hulls 10 may be varied to accommodate different water conditions, as shown in dotted lines in FIG. 2. The hulls may be spaced wide apart for more flexibility and stability, and may be spaced closer together for small rocky rivers and quick turning. In the preferred embodiment, the adjustment means include first and second fastening means 40 and 42 in the form of pins which may be inserted in openings 44 formed in the elongated connector tubes, as can best be seen in FIG. 3. By spacing a fastening pin on either side of sleeve 36, connector tubes 22 may rotate in sleeve 36 to allow a pitch motion between the connector tube and hulls, while preventing axial movement along the elongated connector tubes. In this manner, coupling means C provides flexing in three degrees of freedom. The hulls pitch about a rotational axis along the axis of connector tubes 22. Yaw and roll movements between the hull and connector tubes occur through the coupling due to the flexibility of the bosses because of the plastic material and the geometry of the bosses.

The flexibility of coupling area 32 and bosses 30 of hulls 12 may also be controlled by utilizing a flexible or inflatable bulkhead 46, shown in dotted lines in FIG. 3. The bulkhead could be utilized instead of the vertical frame members 48 shown in FIGS. 3 and 5 to support the kayak in that area and provide adjustability of flexing in coupling area 32. For example, an inflatable collar 46 may be used as a bulkhead wherein the air pressure is adjusted to adjust the support and flexibility of the bulkhead. It is also possible that rigid hulls may be utilized instead of flexible hulls and that by arrangement of suitable bushings, as disclosed, the flexing between the hulls and connecting members may be suitably provided. Inflatable hulls may also be utilized.

Figure 7:
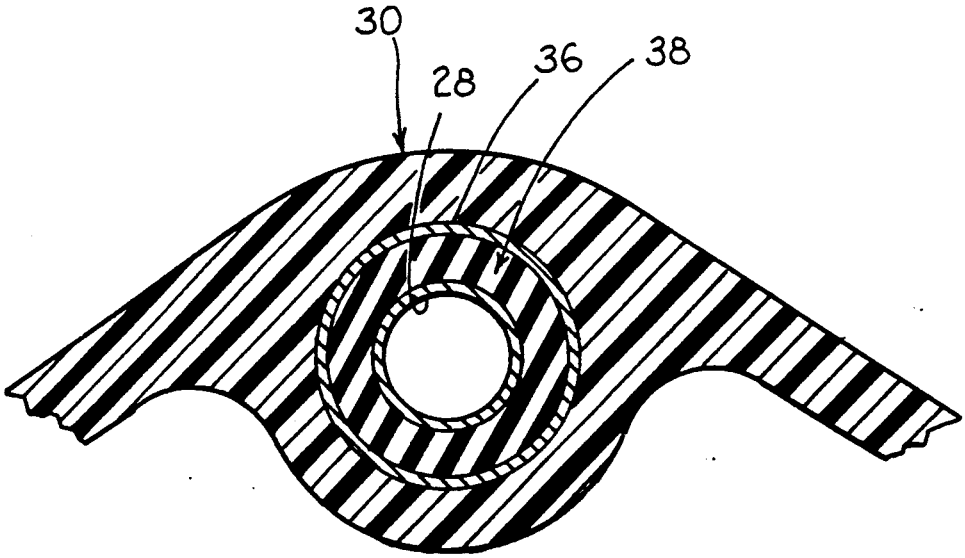
FIG. 7 is a side view of the flexible coupling of FIG. 6.

Another embodiment of means for coupling the rigid tubular connectors and the hulls is illustrated in FIGS. 8–11. A coupling means C' is illustrated which includes a flexible boss 30' which receives a vertical, rigid connector means B'. Connector means B' extends into hull 12 where it is held by a molded flange 50 in any suitable manner. Boss 30' includes an opening 52 which is oval, or non-round, in the preferred embodiment. Connector means B' includes a horizontal tubular connector 54 and vertical tubular connectors 56 which extend down into openings 52. Tubular connectors 54 and 56 are connected together at a pivot 58. Tubular connectors 56 extend through openings 52 down into hulls 12 and are affixed at bottom flanges 50. The oval, or other non-round shape of tubular connectors 56, prevents the tubular connectors and hulls from twisting relative to each other. Of course, round tubular connectors and openings could be utilized with the use of pins. Means for dampening the pivot motion between tubular connectors 54 and 56 includes a pair of dampers 60 and 62. As can best be seen in FIG. 9, damper 60 is connected between the left hull and tubular connector 54, and damper 62 is connected between the right hull and tubular connector 54. Each damper includes a first rod 64 connected to the hull, and a second rod 66 connected to the tubular connector. A spring **64*a* and 66*a* provide resistance to the movement of the rod so that the damper maintains the respective tubular connectors in an equilibrium position, as can best be seen in FIG. 9. A hollow sleeve 70 may be molded in each hull to receive the vertical tubular connectors 56. It is to be understood that the same construction of a hollow sleeve, resilient bushing, and tubular connector, concentrically arranged, as shown in FIGS. 6–7, may also be utilized in the embodiment of FIGS. 8–11. For example, at least one resilient bushing 38 may be provided around tubular connectors 56 as best can be seen in FIG. 10*a*. As in the disclosure of the preferred embodiment, bushings with different durometers may also be utilized to provide each flexible coupling with a desired flexibility to customize the catamaran for the particular style and weight of the boaters, and water conditions. This, together with the geometry and thickness of bosses 30'**, determines the overall flexibility of the coupling and performance.

While a preferred embodiment of the invention has been described using specific terms, such description is for illustrative purposes only, and it is to be understood that changes and variations may be made without departing from the spirit or scope of the following claims.

What is claimed is:

1. A kayak catamaran comprising:

a plurality of laterally spaced longitudinally extending hulls;

cockpit means carried by each of said hulls for accommodating at least one boater on each of said hulls from which said catamaran is paddled;

a plurality of rigid elongated connector means spaced from one another along the length of said hulls extending laterally between said hulls, and said elongated connector means having opposing free ends connected to said hulls; and flexible coupling means for coupling said ends of said elongated connector means to said hulls so that said hulls and elongated connector means move relative to each other generally in three-degrees of freedom.

2. The catamaran of claim 1 wherein said cockpit means include a raised saddle seat and a lower floor.

3. The catamaran of claim 1 wherein said elongated connector means includes cylindrical tubes extending between said hulls which are interconnected only to said hulls.

4. The catamaran of claim 1 wherein said flexible coupling means includes a plurality of flexible bosses integrally carried by said hulls which receive said opposing ends of said elongated connector means.

5. The catamaran of claim 4 including journal means carried by said flexible bosses for receiving said opposing ends of said elongated connector means so that said hulls rotate in a pitch motion relative to said elongated connector means.

6. The catamaran of claim 1 wherein said flexible coupling means includes flex control means for controlling the flexibility of said flexible coupling means so that each hull may be provided with a desired flex characteristic.

7. The catamaran of claim 6 wherein said flex control means includes journal means in which said elongated connector means is received; and bushing means disposed between said elongated connector and said journal means providing a desired degree of flexibility between said hull and said elongated connector means.

8. The catamaran of claim 7 wherein said bushing means comprises a plurality of bushings having a different resiliency.

9. The catamaran of claim 1 wherein said coupling means includes adjustment means for adjusting a length of said elongated connector means so that the lateral distance between said hulls may be varied to accommodate different water conditions.

10. The catamaran of claim 9 wherein said coupling means includes a coupling sleeve receiving said elongated connector means, and said adjustment means includes a first and second fastening means carried on first and second sides of said coupling sleeve which engage said elongated connector means for fixing the relative axial position of said elongated connector means within said sleeve.

11. The catamaran of claim 1 wherein said elongated connector means comprises a first tubular connector extending generally horizontally between said hulls, a second tubular connector pivotally connected to one end of said first tubular connector, and a third tubular connector pivotally connected to an opposing end of said first tubular connector; said second and third tubular connectors extending generally vertically into said hulls; and biasing means maintaining said first, and second, and third tubular connectors in an equilibrium position which allows pivoting of said tubular connectors relative to each other.

12. The catamaran of claim 11 including means for limiting the rotation of said second and third tubular connectors about a vertical axis.

13. The catamaran of claim 11 wherein said flexible coupling means includes a plurality of flexible bosses carried by said hulls which receive said second and third tubular connectors to provide a flexible coupling between said hulls and said tubular connectors.

14. The catamaran of claim 13 wherein said flexible coupling means comprises at least one bushing carried between said second and third tubular connectors and said bosses.

15. A kayak catamaran comprising:

a plurality of laterally spaced longitudinally extending hulls constructed from a flexible polymeric material;

a plurality of cockpit means carried by said hulls for accommodating a boater in a paddling position;

a plurality of rigid elongated connector means spaced from one another along the length of said hulls extending laterally between said hulls, and said elongated connector means having opposing free ends connected to said hulls;

flexible coupling means for coupling said ends of said elongated connector means to said hulls so that said hulls and elongated connector means move relative to each other in three-degrees of freedom; and said flexible coupling means including a plurality of flexible bosses formed as one-piece with said flexible hulls for receiving said opposing ends of said elongated connector means so that said hulls and elongated connector means flex relative to each other generally in three degrees of freedom.

16. The catamaran of claim 15 including journal means carried by said flexible bosses which receive said opposing ends of said elongated connector means, said journal means including hollow coupling sleeves fitted within said flexible bosses which receive said ends of said elongated connector means.

17. The catamaran of claim 16 wherein said journal means includes a flexible bushing means disposed inside said bosses which receive said ends of said elongated connector means.

18. The apparatus of claim 15 wherein said coupling means includes a coupling sleeve receiving said alongated connector means, and said coupling means includes adjustment means for adjusting a length of said elongated connector means so that the lateral distance between said hulls may be varied to accommodate different water conditions.

19. The catamaran of claim 18 wherein said adjustment means includes fastening means fixing an axial position of said elongated connector means relative to said coupling sleeve to prevent relative axial movement while said elongated connector means and coupling sleeve move in relative rotational movement.

20. The catamaran of claim 15 wherein said flexible coupling means includes flex control means for controlling the flexibility of said flexible coupling means so that each coupling may be provided with a desired flex characteristic.

21. The catamaran of claim 20 wherein said flex control means includes journal means in which said elongated connector means is received; and bushing means disposed between said elongated connector and said journal means providing a desired degree of flexibility of movement between said hull and said elongated connector means.

22. The catamaran of claim 21 wherein said bushing means comprises a plurality of bushings having a different resiliency to provide said coupling with a desired flex characteristic.

23. The catamaran of claim 20 wherein said flex control means comprises controlling the thickness and geometry of said flexible bosses molded as one piece with said hull.

24. The catamaran of claim 23 wherein said flex control means includes an adjustable collar disposed with said hulls in a hull area near said flexible bosses whose flexibility may be adjusted to control the flexibility of a said hull area wherein said flexible bosses and hull are molded as one piece.

25. A method of making a catamaran kayak comprising:

molding a plurality of flexible skin hulls from a polymeric material;

joining said hulls together in laterally spaced relationship with elongated connector means spaced along the length of said hulls;

coupling opposing ends of said elongated connector means to said hulls with flexible couplings so that said hulls and elongated connector means move relative to each other in three degrees of freedom;

forming cockpits carried by said hulls for accommodating at least one boater on each of said hulls.

26. The method of claim 25 including affixing a flexible bushing between said ends of said elongated connector means within said flexible coupling to provide said flexible coupling.

27. The method of claim 26 including providing bushings having a different resiliency for at least one of said flexible coupling whereby a desired flex characteristic for that flexible coupling ma be provided to tailor the performance of said hull to the boater.

28. The method of claim 27 including providing said bushings in the form of O-rings which fit on said elongated connector means.

29. The method of claim 25 including forming said flexible coupling by molding flexible bosses as one piece with said flexible hulls and affixing said ends of said elongated connector means within said flexible bosses with their axial position affixed to maintain lateral spacing between said hulls.

30. The method of claim 29 including inserting a sleeve into said flexible bosses, and affixing said ends of said elongated connector means within said sleeve.

31. The method of claim 30 including placing flexible bushings between said sleeves and said ends of said elongated connector means in said flexible couplings.

* * * * *